US008012551B2

(12) United States Patent
Song et al.

(10) Patent No.: US 8,012,551 B2
(45) Date of Patent: Sep. 6, 2011

(54) FAST DRY COATED INKJET PAPER

(75) Inventors: Jay C. Song, Highland Mills, NY (US); Jingxiu Wan, Mason, OH (US); Thomas R. Arnson, Loveland, OH (US); Kapil M. Singh, West Chester, OH (US); Michael F. Koenig, Loveland, OH (US); Timothy J. Bradford, Killen, AL (US)

(73) Assignee: International Paper Company, Memphis, TN (US)

( * ) Notice: Subject to any disclaimer, the term of this patent is extended or adjusted under 35 U.S.C. 154(b) by 236 days.

(21) Appl. No.: 12/474,647

(22) Filed: May 29, 2009

(65) Prior Publication Data

US 2009/0297738 A1 Dec. 3, 2009

Related U.S. Application Data

(60) Provisional application No. 61/130,267, filed on May 29, 2008.

(51) Int. Cl.
*B41M 5/40* (2006.01)

(52) U.S. Cl. ..... 428/32.16; 428/32.21; 428/32.28; 428/32.3; 428/32.34; 428/32.37

(58) Field of Classification Search ..... 428/32.16, 428/32.21, 32.28, 32.3, 32.34, 32.37
See application file for complete search history.

(56) References Cited

U.S. PATENT DOCUMENTS 5,605,750 A 2/1997 Romano et al.
5,783,038 A 7/1998 Donigian et al.
5,851,651 A 12/1998 Chao
5,919,558 A 7/1999 Chao
5,985,424 A 11/1999 DeMatte et al.
6,187,430 B1 * 2/2001 Mukoyoshi et al. ..... 428/331
6,194,077 B1 2/2001 Yuan et al.
6,242,082 B1 6/2001 Mukoyoshi et al.
6,713,550 B2 3/2004 Schliesman et al.
6,764,726 B1 7/2004 Yang et al.

(Continued)

FOREIGN PATENT DOCUMENTS

EP 0652324 5/1995

(Continued)

OTHER PUBLICATIONS

Pigment Coating Techniques, Chapter 24, pp. 415-417, Jukka Linnonmaa and Michael Trefz.

*Primary Examiner* — Betelhem Shewareged

(74) *Attorney, Agent, or Firm* — Thomas W. Barnes, III; Eric W. Guttag

(57) ABSTRACT

Disclosed are a coating composition, coated article, and a method for treating one or more sides of the printable web with the composition, for providing improved printing ink dry time and gloss. The coating composition comprises: a calcium carbonate pigment component comprising a mixture high and low surface area calcium carbonate pigment; a metal salt drying agent; and a cationic dye fixing agent; a pigment binder; optionally a plastic pigment; and optionally an optical brightener; and which provides: a solids content of at least about 25%; a ratio of high to low surface area calcium carbonate in the range of from about 0.5:1 to about 20:1; and a ratio of calcium carbonate pigment component to pigment binder in the range of from about 4:1 to about 50:1.

20 Claims, 6 Drawing Sheets

U.S. PATENT DOCUMENTS

| | | | |
|---|---|---|---|
| 6,783,818 | B2 | 8/2004 | Tsuchiya et al. |
| 6,808,767 | B2 | 10/2004 | Schliesman |
| 6,815,021 | B1 | 11/2004 | Ishikawa et al. |
| 6,818,685 | B1 | 11/2004 | Chapman |
| 6,857,733 | B2 | 2/2005 | Issler |
| 6,979,481 | B2 | 12/2005 | Gaynor et al. |
| 7,018,708 | B2 | 3/2006 | Song et al. |
| 7,056,969 | B2 | 6/2006 | Cuch et al. |
| 7,172,651 | B2 | 2/2007 | Chen et al. |
| 2004/0032473 | A1 | 2/2004 | Ishimoto et al. |
| 2004/0033323 | A1 | 2/2004 | Gaynor et al. |
| 2004/0038056 | A1 | 2/2004 | Song et al. |
| 2004/0197496 | A1 | 10/2004 | Song et al. |
| 2005/0041084 | A1 | 2/2005 | Mukherjee et al. |
| 2005/0146589 | A1 | 7/2005 | Gibbison et al. |
| 2005/0260428 | A1 | 11/2005 | Song et al. |
| 2006/0060317 | A1 | 3/2006 | Roding et al. |
| 2006/0062942 | A1 | 3/2006 | Gaynor et al. |
| 2006/0115612 | A1 | 6/2006 | Nakata et al. |
| 2006/0137574 | A1 | 6/2006 | Preston et al. |
| 2006/0159910 | A1 | 7/2006 | Song et al. |
| 2006/0204688 | A1 | 9/2006 | Ushiku |
| 2007/0014941 | A1 | 1/2007 | Chen et al. |
| 2007/0076075 | A1 | 4/2007 | Schmid et al. |
| 2007/0087138 | A1 | 4/2007 | Koenig et al. |
| 2007/0125267 | A1* | 6/2007 | Song et al. ..... 106/214.1 |
| 2007/0235119 | A1* | 10/2007 | McManus et al. ..... 156/60 |
| 2008/0075869 | A1 | 3/2008 | Nellie |

FOREIGN PATENT DOCUMENTS

| | | | |
|---|---|---|---|
| EP | 0747235 | | 12/1996 |
| EP | 0758696 | | 2/1997 |
| EP | 1122085 | B1 | 2/2003 |
| WO | 9528285 | | 10/1995 |
| WO | 9805512 | | 2/1998 |
| WO | 9852765 | | 11/1998 |
| WO | 0032407 | | 6/2000 |
| WO | WO2005/115763 | A1 | 12/2005 |
| WO | WO 2006/050850 | A1 * | 5/2006 |
| WO | WO2006049545 | A1 | 5/2006 |

* cited by examiner

FAST DRY COATED INKJET PAPER

RELATED PATENT APPLICATION

This is a non-provisional application which claims priority from U.S. Provisional Patent Application Ser. No. 61/130,267 filed on May 29, 2008.

BACKGROUND

1. Field of the Invention

The present invention broadly relates to a coating composition which may be used with printable (e.g., paper) webs. The present invention also broadly relates to printable (e.g., paper) webs treated on one or both sides with the coating composition to impart benefits such as, for example, improved ink dry time and gloss. The present invention further broadly relates a method for treating one or more sides of a printable (e.g., paper) web with the coating composition.

2. Related Art

In a conventional calendered papermaking process, the fibrous web from the press roll section may contain from about 32 to about 45 wt. % solids. These solids may include wood pulp and/or synthetic fibers along with various additives such as sizing agents, binders, fillers, pigments, etc. The print quality of such calendared papers, as well as other properties of the papers, such as brightness, opacity, paper smoothness, etc., may be improved by coating the paper with different coating compositions that include color solids. The coating composition used to provide these color solids may comprise a mixture of: (1) a coating color having pigment(s) such as clay, calcium carbonate, titanium dioxide, etc., (2) a binder or binders such as modified starch, styrene butadiene rubber, polyvinyl acetate, vinyl acrylic, polyvinyl alcohol, etc.; and (3) various functional additives such as dispersants, viscosity modifiers, crosslinking agents, lubricants, etc. The resulting mixture may be applied to the paper web at a solids content of, for example, about 40% or greater by weight.

These coated papers may be used for a wide range of products including packaging, art paper, brochures, magazines, catalogues, leaflets, etc. For example, these coated papers may be used in inkjet printing and recording processes. Ink jet printing and recording systems using aqueous inks are now well known. These systems usually generate almost no noise and may easily perform multicolor recordings for business, home and commercial printing applications. But conventional coated papers for inkjet printing may remain poor in balancing good print density, internal sizing (as measured by the Hercules Sizing Test or HST), color-to-color bleed, print sharpness, image dry time, gloss, etc. Accordingly, there is still a need to provide such high-performance functionality to coated papers useful in inkjet printing, especially those substrates having improve image dry time and gloss.

SUMMARY

According to a first broad aspect of the present invention, there is provided a composition comprising a coating composition comprising:

- a calcium carbonate pigment component comprising a mixture high and low surface area calcium carbonate pigment;
- a metal salt drying agent;
- a cationic dye fixing agent; and
- a pigment binder;
- wherein the coating composition provides:

- a solids content of at least about 25% by weight;
- a ratio of high surface area calcium carbonate to low surface area calcium carbonate in the range of from about 0.5:1 to about 20:1; and
- a ratio of calcium carbonate pigment component to pigment binder in the range of from about 4:1 to about 50:1.

According to a second broad aspect of the present invention, there is provided an article comprising:

- a printable web having first and second surfaces; and
- a coating on at least one of the first and second surfaces, wherein the coating comprises:
  - a calcium carbonate pigment component comprising a mixture high and low surface area calcium carbonate pigment;
  - a metal salt drying agent;
  - a cationic dye fixing agent; and
  - a pigment binder;
  - wherein the coating has:
    - a ratio of high surface area calcium carbonate to low surface area calcium carbonate in the range of from about 0.5:1 to about 20:1; and
    - a ratio of calcium carbonate pigment component to pigment binder in the range of from about 4:1 to about 50:1;
  - wherein the coating provides:
    - a printable web surface loading on each surface on which the coating is present is in an amount of at least about 3 gsm.

According to a third broad aspect of the present invention, there is provided a method comprising the following steps of:

(a) providing a printable web having first and second surfaces; and (b) providing a liquid coating composition comprising:
- a calcium carbonate pigment component comprising a mixture high and low surface area calcium carbonate pigment;
- a metal salt drying agent;
- a cationic dye fixing agent; and
- a pigment binder;
- wherein the coating composition has:
  - a ratio of high surface area calcium carbonate to low surface area calcium carbonate in the range of from about 0.5:1 to about 20:1; and
  - a ratio of calcium carbonate pigment component to pigment binder in the range of from about 4:1 to about 50:1;
- wherein the coating composition has:
  - a solids content of at least about 25% by weight; and (c) treating at least one of the first and second surfaces of the printable web of step (a) with the coating composition of step (b), wherein the printable web surface loading on each surface on which the coating is present is in an amount at least about 3 gsm.

BRIEF DESCRIPTION OF THE DRAWINGS

The invention will be described in conjunction with the accompanying drawings, in which.

DETAILED DESCRIPTION

Figure 1:
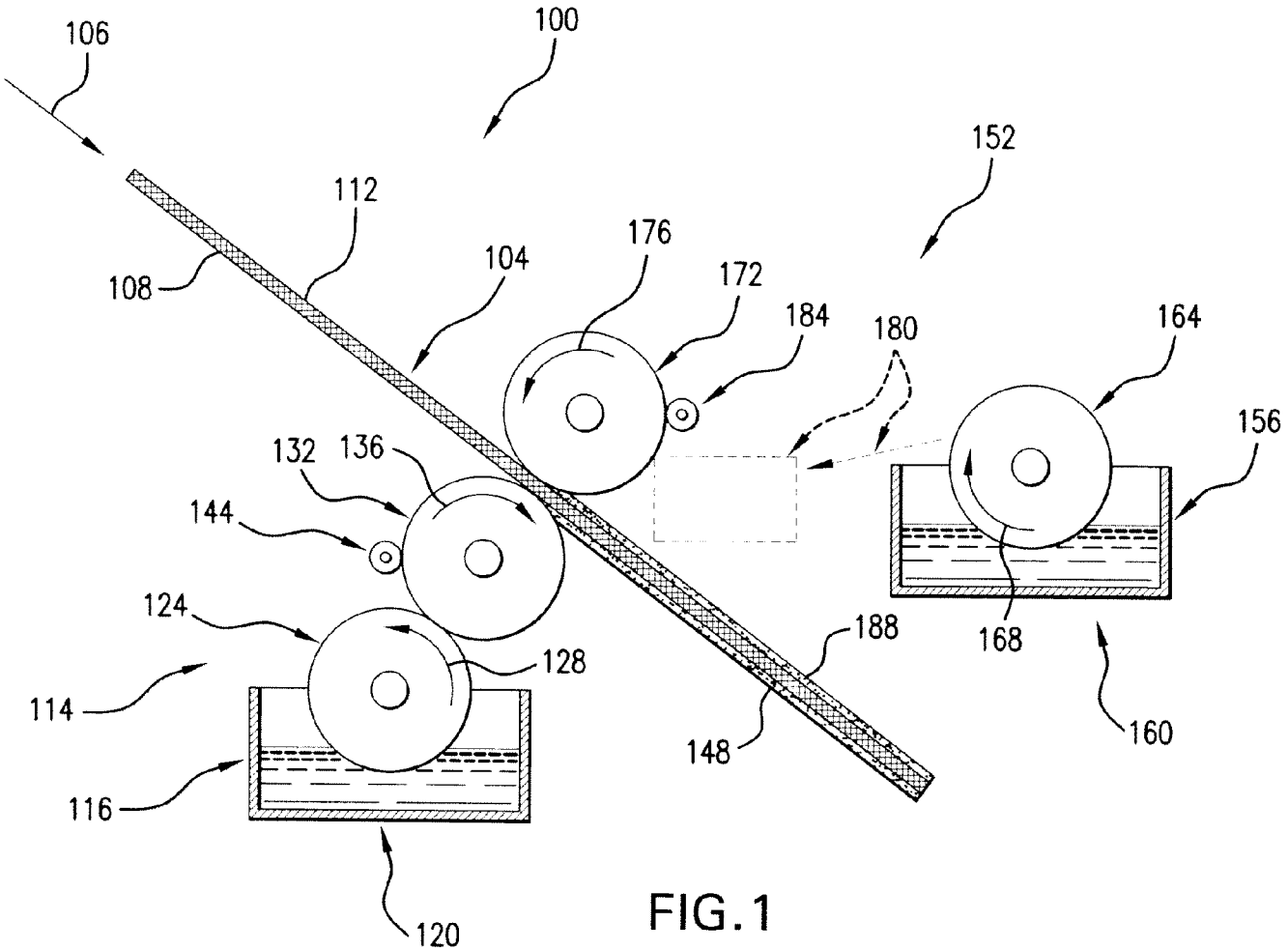
FIG. 1 is a schematic diagram illustrating an embodiment of a method for coating a paper web with a coating composition according to the present invention using a metering rod size press.

It is advantageous to define several terms before describing the invention. It should be appreciated that the following definitions are used throughout this application.

Definitions

Where the definition of terms departs from the commonly used meaning of the term, applicant intends to utilize the definitions provided below, unless specifically indicated.

For the purposes of the present invention, directional terms such as "top", "bottom", "side," "front," "frontal," "forward," "rear," "rearward," "back," "trailing," "above", "below", "left", "right", "horizontal", "vertical", "upward", "downward", etc. are merely used for convenience in describing the various embodiments of the present invention. The embodiments of the present invention may be oriented in various ways. For example, the embodiments shown in FIGS. 1 through 5 may be flipped over, rotated by 90° in any direction, etc.

For the purposes of the present invention, the term "printable web" refers to any material which may be printed on with an inkjet printing process. Printable substrates may include webs, sheets, strips, etc., may be in the form of a continuous roll, a discrete sheet, etc., and may comprise various materials or combinations of materials, including, for example, plastics (polymers), paper webs, non-wovens, etc.

For the purposes of the present invention, the term "paper web" refers to a fibrous web that may be formed, created, produced, etc., from a mixture, furnish, etc., from paper fibers, plus any other optional papermaking additives such as, for example, fillers, wet-strength agents, optical brightening agents (or fluorescent whitening agent), etc. Paper webs may include an uncoated paper web, coated paper web, etc. The paper web may be in the form of a continuous roll, a discrete sheet, etc.

For the purposes of the present invention, the term "low density coated paper web" refers to a paper web which has 0 or a minimal (e.g., below about 8 gsm, for example below about 6 gsm) paper surface loading of a coating composition present on one or more sides or surfaces of a paper web. In one embodiment of a low density coated paper web, a coating may be present in an amount from about 0.5 to about 4 gsm (e.g., from about 0.75 to about 3 gsm, more typically from about 1 to about 3 gsm) on one or both sides or surfaces of a paper web.

For the purposes of the present invention, the term "uncoated paper web" refers to a paper web which has 0 or substantially 0 paper surface loading of a coating composition present on one or both sides or surfaces of the paper web.

For the purposes of the present invention, the term "single-side coated paper web" refers to a paper web which has a surface loading of a coating composition present on one, but not both, sides or surfaces of the paper web.

For the purposes of the present invention, the term "double-side coated paper web" refers to a paper web which has a surface loading of a coating composition present on both sides or surfaces of the paper web.

For the purposes of the present invention, the term "calendered paper" refers to a paper web which has been subjected to calendering to, for example, smooth out the paper for enabling printing and writing on the paper, and to increase the gloss on the paper surface. For example, calendering may involve a process of using pressure for embossing a smooth surface on the still rough paper surface. Calendering of paper may be carried out on a calendar which may comprise a series of rolls at the end of a papermaking machine (on-line), or separate from the papermaking machine (off-line).

For the purposes of the present invention, the term "paper filler" refers commonly to mineral products (e.g., calcium carbonate, kaolin clay, etc.) which may be used in paper making to reduce materials cost per unit mass of the paper, increase opacity, increase smoothness, etc. These mineral products may be finely divided, for example, the size range of from about 0.5 to about 5 microns.

For the purposes of the present invention, the term "coating composition" refers to those compositions, which comprise, at minimum: a calcium carbonate pigment component; a metal salt drying agent; a cationic dye fixing agent; and a pigment binder; and a. These coating compositions may also include other optional additives, such as, for example, plastic pigments, optical brightening agents, fluorescent whitening agents, solvents, diluents, anti-scratch and mar resistance agents, etc. The coating composition may be formulated as an aqueous slurry, a colloidal suspension, a liquid mixture, a thixotropic mixture, etc.

For the purposes of the present invention, the term "solids basis" refers to the weight percentage of each of the respective solid materials (e.g., calcium carbonate pigment component; a metal salt drying agent; a cationic dye fixing agent; a pigment binder; plastic pigment, optical brightening agent, etc.) present in the coating composition, coating, etc., in the absence of any liquids (e.g., water). Unless otherwise specified, all percentages given herein for the solid materials are on a solids basis.

For the purposes of the present invention, the term "solids content" refers to the percentage of non-volatile, non-liquid components (by weight) that are present in the composition, etc.

For the purposes of the present invention, the term "pigment" refers to a material (e.g., finely divided particulate matter) which may be used or may be intended to be used to affect optical properties of a printable (e.g., paper) web.

For the purposes of the present invention, the term "calcium carbonate" refers various calcium carbonates which may be used as pigments, such as precipitated calcium carbonate (PCC), ground calcium carbonate (GCC), modified PCC and/or GCC, etc.

For the purposes of the present invention, the term "precipitated calcium carbonate (PCC)" refers to a calcium carbonate which may be manufactured by a precipitation reaction and which may used as a pigment. PCC may comprise almost entirely of the calcite crystal form of $CaCO_3$. The calcite crystal may have several different macroscopic shapes depending on the conditions of production. Precipitated calcium carbonates may be prepared by the carbonation, with carbon dioxide ($CO_2$) gas, of an aqueous slurry of calcium hydroxide ("milk of lime"). The starting material for obtaining PCC may comprise limestone, but may also be calcined (i.e., heated to drive off $CO_2$), thus producing burnt lime, CaO. Water may added to "slake" the lime, with the resulting "milk of lime," a suspension of $Ca(OH)_2$, being then exposed to bubbles of $CO_2$ gas. Cool temperatures during addition of the $CO_2$ tend to produce rhombohedral (blocky) PCC particles. Warmer temperatures during addition of the $CO_2$ tend to produce scalenohedral (rosette-shaped) PCC particles. In either case, the end the reaction occurs at an optimum pH where the milk of lime has been effectively converted to $CaCO_3$, and before the concentration of $CO_2$ becomes high enough to acidify the suspension and cause some of it to redissolve. In cases where the PCC is not continuously agitated or stored for many days, it may be necessary to add more than a trace of such anionic dispersants as polyphosphates. Wet PCC may have a weak cationic colloidal charge. By contrast, dried PCC may be similar to most ground $CaCO_3$ products in having a negative charge, depending on whether dispersants have been used. The calcium carbonate may be precipitated from an aqueous solution in three different crystal forms: the vaterite form which is thermodynamically unstable, the calcite form which is the most stable and the most abundant in nature, and the aragonite form which is metastable under normal ambient conditions of temperature and pressure, but which may convert to calcite at elevated temperatures. The aragonite form has an orthorhombic shape that crystallizes as long, thin needles that may be either aggregated or unaggregated. The calcite form may exist in several different shapes of which the most commonly found are the rhombohedral shape having crystals that may be either aggregated or unaggregated and the scalenohedral shape having crystals that are generally unaggregated.

For the purposes of the present invention, the term "low particulate surface area" with reference to the calcium carbonate pigment refers to a BET specific surface area of about 30 meters square per gram (hereinafter "msg") or less, for example, from about 5 to about 30 msg, more typically from about 8 to about 16 msg.

For the purposes of the present invention, the term "high particulate surface area" with reference to the calcium carbonate pigment refers to a BET specific surface area of greater than about 30 meters square per gram (hereinafter "msg"), for example, from about 30 to about 200 msg, more typically from about 50 to about 120 msg.

For the purposes of the present invention, the term "pigment binder" refers to a binder agent for printable webs (e.g., paper webs) which may be used to improve the pigment binding strength of the coating composition, coating, etc. Pigment binders may be hydrophilic. Suitable pigment binders may include synthetic or naturally occurring polymers (or a combination of different polymers), for example, a polyvinyl alcohol (PVOH), starch binders, proteinaceous adhesives such as, for example, casein or soy proteins, etc.; polymer latexes such as styrene butadiene rubber latexes, acrylic polymer latexes, polyvinyl acetate latexes, styrene acrylic copolymer latexes, etc., or a combination thereof. The pigment binder may also be substantially free of starch binders and/or latexes as binders to improve the dry time of the coated printable web and to improve the processability of the printable web during the coating process.

For the purposes of the present invention, the term "substantially free" refers to a coating composition, coating, etc., having less than about 0.1% starch and/or latex binder by weight of the coating composition, coating, etc.

For the purposes of the present invention, the term "starch binder" refers to a binder agent for pigments and/or printable (e.g., paper) webs which comprises starch, a starch derivative, etc., or a combination thereof. Suitable starch binders may be derived from a natural starch, e.g., natural starch obtained from a known plant source, for example, wheat, maize, potato, tapioca, etc. The starch binder may be modified (i.e., a modified starch) by one or more chemical treatments known in the paper starch binder art, for example, by oxidation to convert some of —$CH._2OH$ groups to —COOH groups, etc. In some cases the starch binder may have a small proportion of acetyl groups. Alternatively, the starch binder may be chemically treated to render it cationic (i.e., a cationic starch) or amphoteric (i.e., an amphoteric starch), i.e., with both cationic and anionic charges. The starch binder may also be a starch converted to a starch ether, or a hydroxyalkylated starch by replacing some —OH groups with, for example, —$OCH_2CH_2OH$ groups, —$OCH_2CH_3$ groups, —$OCH_2CH_2CH_2OH$ groups, etc. A further class of chemically treated starch binders which may be used are known as the starch phosphates. Alternatively, raw starch may be hydrolyzed by means of a dilute acid, an enzyme, etc., to produce a starch binder in the form of a gum of the dextrin type.

For the purposes of the present invention, the term "metal salt drying agent" refers to those metal salts which may improve the dry time of inks printed on printable webs by inkjet printing processes. These metal salt drying agents may include metal salts such as sodium chloride, calcium chloride, calcium nitrate, magnesium chloride, magnesium nitrate, aluminum chloride, sodium sulfate, aluminum chloride, aluminum nitrate, aluminum sulfate, potassium chloride, sodium aluminum sulfate, vanadium chloride, magnesium sulfate, sodium silicates, etc., or combinations thereof.

For the purposes of the present invention, the term "cationic dye fixing agent" refers to those cationic compounds (e.g., nitrogen-containing compounds) or mixtures of such compounds which may aid in fixing, trapping, etc., inks printed by inkjet printing processes, and which may provide other properties, including water fastness. These cationic dye fixing agents may include compounds, oligomers and polymers which contain one or more quaternary ammonium functional groups, and may include cationic water soluble polymers that are capable of forming a complex with anionic dyes. Such functional groups may vary widely and may include substituted and unsubstituted amines, imines, amides, urethanes, quaternary ammonium groups, dicyandiamides and the like. Illustrative of such compounds are polyamines, polyethyleneimines, polymers or copolymers of diallyldimethyl ammonium chloride (DADMAC), copolymers of vinyl pyrrolidone (VP) with quaternized diethylaminoethylmethacrylate (DEAMEMA), polyamides, cationic polyurethane latexes, cationic polyvinyl alcohols, polyalkylamines dicyandiamid copolymers, amine glycidyl addition polymers, poly [oxyethylene (dimethyliminio) ethylene (dimethyliminio) ethylene] dichlorides, etc., or combinations thereof. These cationic dye fixing agents may include low to medium molecular weight cationic polymers and oligomers having a molecular equal to or less than 100,000, for example, equal to or less than about 50,000, e.g., from about 10,000 to about 50,000. Illustrative of such materials are polyalkylamine dicyandiamide copolymers, poly[oxyethylene(dimethyliminio ethylene(dimethyliminioethylene] dichlorides and polyamines having molecular weights within the desired range. Cationic dye fixing agents suitable herein may include low molecular weight cationic polymers such as polyalkylamine dicyandiamide copolymer, poly[oxyethylene dimethyliminio)ethylene(dimethyliminio)ethylene] dichloride, for example, low molecular weight polyalkylamine dicyandiamid copolymers. See U.S. Pat. No. 6,764,726 (Yang et al.), issued Jul. 20, 2004, the entire disclosure and contents of which is hereby incorporated by reference.

For the purposes of the present invention, the term "brightness" refers to the diffuse reflectivity of paper, for example, at a mean wavelength of light of 457 nm. As used herein, brightness of the paper web may be measured by, for example, in terms of GE Brightness or ISO Brightness.

For the purposes of the present invention, the term "opacity" refers to the ability of a paper to hide things such as print images on subsequent sheets or printed on the back, e.g., to minimize, prevent, etc., show-through, etc. As used herein, opacity of the paper web may be measured by, for example, in terms of TAPPI opacity and show-through. TAPPI opacity may be measured by T425 om-91.

For the purposes of the present invention, the term "show-through" refers to the degree to which printing on one side of a paper sheet may be seen through the other side of the same sheet. Show-through may correlate to opacity of the paper, the degree of ink penetration into the paper, etc. Values for show-through may be determined by the Show-Through Test Methodology, which is attached hereto as an appendix and which is hereby incorporated by reference herein in its entirety.

For the purposes of the present invention, the term "paper smoothness" refers to the extent to which the paper surface deviates from a planar or substantially planar surface, as affected by the depth of the paper, paper width, numbers of departure from that planar surface, etc. As used herein, the paper smoothness of a paper web may be measured by, for example, in terms of Parker Print Smoothness. Parker Print Smoothness may be measured by TAPPI test method T 555 om-99.

For the purposes of the present invention, the term "print quality" refers to those factors, features, characteristics, etc., that may influence, affect, control, etc., the appearance, web may be measured by, for example, in terms of one or more of: (1) print density/contrast (e.g., for BW/color/monochrome); (2) color gamut or color richness (e.g., for digital printing such as ink jet printing, laser printing, etc.); (3) dry times); (4) print gloss or print mottle; (5) etc. For example, black optical print density may be measured by TAPPI method 1213 sp-03. Print mottle may be measured based on 2nd cyan values according to the method disclosed in U.S. Published Application No. 20060060317 (Roding, et al.), published Mar. 23, 2006, which is herein incorporated by reference in its entirety.

For the purposes of the present invention, the term "gloss" refers to the ability of paper to reflect some portion of the incident light at the mirror angle. Gloss may be based on a measurement of the quantity of light specularly reflected from the surface of a paper specimen at a set angle, for example, at 75 degrees, such as in the case of 75 degree gloss (and as measured by TAPPI test method T 480 om-92).

For the purposes of the present invention, the term "print gloss" refers to a gloss measurement made on a printed paper.

For the purposes of the present invention, the term "digital printing" refers to reproducing, forming, creating, providing, etc., digital images on a print media, for example, paper, Digital printing may include laser printing, ink jet printing, dry toner electrophotographic printing, liquid toner electrophotographic printing, flexographic printing, etc.

For the purposes of the present invention, the term "laser printing" refers to a digital printing technology, method, device, etc., that may use a laser beam to create, form produce, etc., a latent image on, for example, photoconductor drum. The light of laser beam may later create charge on the drum which may then pick up toner which carries an opposite charge. This toner may then be transferred to the paper and the resulting print image created, formed, produced, etc., fused to the paper through, for example, a fuser. The toner transfer and fusing process may be important to the paper properties.

For the purposes of the present invention, the term "electrophotographic recording media" refers to a media which is capable of recording an image in electrophotographic recording process. Electrophotographic recording media may be in the form of sheets, webs, strips, films, panes, pages, pieces, etc., which may be continuous in form (e.g., webs) for subsequent subdividing into discrete units, or which may be in the form of discrete units (e.g., a sheet).

For the purposes of the present invention, the term "electrophotographic recording process" refers to a process which records images on a media by xerography or electrophotography. In an electrophotographic process, the image is often formed on of the media by toner particles which are deposited one surface or side of the medium, and are then thermally fixed and/or fused to that one surface or side of the medium, for example, by heating. The electrophotographic recording medium may have two relatively smooth or flat sides or surfaces, or may have one side or surface which is textured, uneven or nonsmooth/nonflat, while the other side or surface is relatively smooth or flat.

For the purposes of the present invention, the term "ink jet printing" refers to a digital printing technology, method, device, etc., that may form images on paper by spraying, jetting, etc., tiny droplets of liquid inks onto the paper through the printer nozzles. The size (e.g., smaller size), precise placement, etc., of the ink droplets may be provide higher quality inkjet prints. Ink jet printing may include continuous ink jet printing, drop-on-demand ink jet printing, etc.

For the purposes of the present invention, the term "liquid toner electrophotographic printing" (e.g., may be referred to in the art as "indigo printing") refers to an electrophotographic printing technology, method, device, etc., which may use liquid toners (instead of dry or solid toners) for electrophotographic printing. In liquid toner electrophotographic printing, the toner particles may be applied to the paper from dispersion in a liquid medium.

For the purposes of the present invention, the term "form printing" refers to printing on a print media formed to a particular shape, such as, for example, an envelope, business form, customized form, etc., and which may be further processed, manipulated, etc., to provide the final product.

For the purposes of the present invention, the term "offset printing" refers to a printing technology, method, device, etc., in which images on the printing plates may be transferred to, for example, transferred to rubber blankets, rollers, etc., and then to paper to provide the printed image. In offset printing, the paper does not come directly in contact with the printing plates.

For the purposes of the present invention, the term "print density" refers to the optical density which is a measure of the light absorbing property of a print image. It may be expressed as the logarithm of the reciprocal to the base 10 of the reflectance from the print image being measured. For example, the higher the print density, the darker the print image may appear. Higher print densities provide a higher contrast, a sharper image for viewing, etc. An X-Rite 418 reflection Densitometer may be used to measure black optical density.

For the purposes of the present invention, the term "print contrast" refers to the difference in print density between printed and unprinted areas.

For the purposes of the present invention, the term "color gamut" refers to the total collection of possible colors in any color reproduction system and may be defined by a complete subset colors. A higher color gamut value indicates a more vivid color print quality. Color gamut may be obtained by measuring the CIE L*, a*, b* of a series of color blocks, including white (unprinted area), cyan, magenta, yellow, red, green, blue and black. The CIE L* represents the whiteness. The value of L* may range from zero (representing black) to 100 (representing white or a perfectly reflecting diffuser). The value of a* represents the degree of green/red. A positive a* is red, while a negative a* is green. A positive b* is yellow, while a negative b* is blue. The CIE L*, a* and b* values may be measured by X-Rite 528 using a D65 light source and a 10-degree viewing angle.

For the purposes of the present invention, the term "color richness" refers to a more vivid or vibrant color print with high print density and high color gamut values.

For the purposes of the present invention, the term "print mottle" refers to non-uniformity in the print image which may be due to unevenness in ink lay, non-uniform ink absorption, etc., across the paper surface. Print mottle may be measured using a scanner based mottle tester such as the C3PATX03 Formation and Mottle Test with an Agfa Model DUOSCAN scanner. The paper sample to be tested is first printed on a test ink jet printer. The test pattern must include a block of solid black (100%) image. The color block is a square of about 20-50 mm by 20-50 mm. After 20 minutes of waiting time, or when the printed image is fully dried, the printed sample is positioned on the scanner with printed face down. The scanner is set at a resolution of 500 ppi (pixel per inch). An Verity software (Verity IA LLC, 2114 Sunrise Drive, Appleton, Wis. 54914) may be used to analyze the test data from the scanner. An appropriate dimension for testing based on the color block dimension is set. Two mottle indices may be measured: Micro Mottle Index and Macro Mottle Index. The Micro Mottle Index measures density variations within an area of 0.1 $in^2$; while the macro mottle index measures the density variations of the averaged density values of each square of 0.1 $in^2$. The lower the mottle index value, the better the print quality.

For the purposes of the present invention, the term "color-to-color bleed" refers to the spreading of one color ink into another color ink on paper which may reduce t he resolution of the colored text and lines on a colored background. For example blue and black bars may be printed over a yellow color background. Green and black bars may be printed over magenta color background, and red and black bars may be printed over cyan color background. The smallest distance in microns between two color bars without bridging (or color intruding more than half way to the neighboring color bar) is recorded as the color-to-color bleed index. In other words, the smaller the value of color-to-color bleeds, the better the print quality. Distances which may be tested include 50 microns, 100 microns, 150 microns, 300 microns, etc. In some embodiments of the present invention, the tested distance may reach 150 microns or less before bridging (bleed) occurs, which may be considered a "good" color-to-color bleed property.

For the purposes of the present invention, the term "liquid" refers to a non-gaseous fluid composition, compound, material, etc., which may be readily flowable at the temperature of use (e.g., room temperature) with little or no tendency to disperse and with a relatively high compressibility.

For the purposes of the present invention, the term "viscosity," with reference to coating compositions, refers to Brookfield viscosity. The Brookfield viscosity may be measured by a Brookfield viscometer at 150° F., using a #5 spindle at 100 rpm.

For the purposes of the present invention, the term "printable web surface loading" refers to amount of coating present on a given side or surface of the printable web treated. Printable web surface loading may be defined in terms of grams of composition per square meter of paper web (hereinafter referred to as "gsm").

For the purposes of the present invention, the term "coater" refers to a device, equipment, machine, etc., which may be used to treat, apply, coat, etc., a paper compositions to one or more sides or surfaces of a printable (e.g., paper) web, for example, just after the paper web has been dried for the first time. Coaters may include air-knife coaters, rod coaters, blade coaters, size presses, etc. See G. A. Smook, Handbook for Pulp and Paper Technologists ($2^{nd}$ Edition, 1992), pages 289-92, the entire contents and disclosure of which is herein incorporated by reference, for a general description of coaters that may be useful herein. Size presses may include a puddle size press, a metering size press, etc. See G. A. Smook, Handbook for Pulp and Paper Technologists ($2^{nd}$ Edition, 1992), pages 283-85, the entire contents and disclosure of which is herein incorporated by reference, for a general description of size presses that may be useful herein.

For the purposes of the present invention, the term "flooded nip size press" refers to a size press having a flooded nip (pond), also referred to as a "puddle size press." Flooded nip size presses may include vertical size presses, horizontal size presses, etc. For the purposes of the present invention, the term "metering size press" refers to a size press that includes a component for spreading, metering, etc., deposited, applied, etc., coating composition or coating on a printable (e.g., paper) web side or surface. Metering size presses may include a rod metering size press, a gated roll metering size press, a doctor blade metering size press, etc.

For the purposes of the present invention, the term "rod metering size press" refers to metering size press that uses a rod to spread, meter, etc., the coating composition or coating on the printable (e.g., paper) web surface. The rod may be stationary or movable relative to the printable web.

For the purposes of the present invention, the term "gated roll metering size press" refers to a metering size press that may use a gated roll, transfer roll, soft applicator roll, etc. The gated roll, transfer roll, soft applicator roll, etc., may be stationery relative to the printable (e.g., paper) web, may rotate relative to the printable web, etc.

For the purposes of the present invention, the term "doctor blade metering size press" refers to a metering press which may use a doctor blade to spread, meter, etc., the coating composition or coating on the printable (e.g., paper) web surface.

For the purposes of the present invention, the term "room temperature" refers to the commonly accepted meaning of room temperature, i.e., an ambient temperature of 20° to 25° C.

For the purposes of the present invention, the term "coating" refers to one or more layers, coverings, films, skins, etc., formed, created, prepared, etc., from a coating composition which remains predominantly on the surface(s) of the printable (e.g., paper) web.

For the purposes of the present invention, the term "remains predominantly on the surface(s) of the printable web" refers to the coating composition or coating remaining primarily on the surface of the printable (e.g., paper) web, and not being absorbed by or into the interior of the web.

For the purpose of the present invention, the term "treating" with reference to the coating composition may include depositing, applying, spraying, coating, daubing, spreading, wiping, dabbing, dipping, etc.

For the purpose of the present invention, the term "Hercules Sizing Test" or "HST" refers to a test of resistance to penetration of, for example, an acidic water solution through paper. The HST may be measured using the procedure of TAPPI 530 pm-89. See U.S. Pat. No. 6,764,726 (Yang et al.), issued Jul. 20, 2004, the entire disclosure and contents of which is hereby incorporated by reference.

Description

Embodiments of the coating compositions, printable (paper) webs coated with these compositions and methods for coating printable (paper) webs with these coating compositions of the present invention may provide several benefits, advantages, etc. These benefits, advantages, etc., may include: (1) improved ink dry time; (2) improved gloss; (3) increased color gamut; and/or (4) reduced print mottle.

Paper brightness may be improved by embodiments of the compositions, paper webs and coating methods of the present invention. For example, brightness of the coated paper web may increased be by 0.5-1.3 point. Embodiments of coated paper webs of the present invention may have brightness values of at least about 80, for example, from about 82 to about 100, more typically from about 84 to about 100.

Paper opacity may be improved by embodiments of the compositions, paper webs and coating methods of the present invention with reduced print show-through. Embodiments of the coated paper webs of the present invention may increase paper opacity of the size press treated paper by, for example, 0.5-1 point. Paper opacity may be important to reduce print show-through, and may be especially beneficial for duplex printing. Embodiments of coated paper webs of the present invention may have opacity values of at least about 85, for example, from about 87 to about 105, more typically from about 90 to about 97. Embodiments of coated paper webs of the present invention may also have show-through values of about 0.02 or less, for example, about 0.015 or less, more typically about 0.01 or less.

A smoother print surface is beneficial for electrophotographic printing process as a smoother printable (e.g., paper) web provides a more uniform print quality and a higher print gloss, as measured by Parker Print Smoothness. Embodiments of coated printable (e.g., paper) webs of the present invention may have Parker Print Smoothness (measured in terms of 10 kgf/cm$^2$ force applied) values of less than or equal to about 5 microns, for example, less than about 4 microns, such as less than or equal to 3 microns (e.g., less than or equal to about 2 microns), and also including any and all ranges and subranges therein. The Parker Print Smoothness of the coated web may be improved by at least about 5%, for example, at least about 20%, possibly as much as by at least about 30%, e.g., at least about 40%, compared to that of conventional coated paper substrates. In an embodiment of a coated paper according to the present invention, the improvement in the Parker Print Smoothness may be in the range or from about 10 to about 20%, compared to that of conventional coated paper substrates.

Print quality may be improved by embodiments of the compositions, printable (e.g., paper) webs and coating methods of the present invention. For example, the embodiments of the coated printable (e.g., paper) webs of the present invention may also provide increase color gamut for inkjet printing. A higher color gamut value may provide a more vivid color print quality. The embodiments of the coated printable (e.g., paper) webs of the present invention may also provide a higher black optical print density. Higher print density is desired since it may give a higher contrast or a sharper image for viewing. Embodiments of the coated printable (e.g., paper) webs of the present invention may provide, for example, black optical print density values of from about 1.1 to about 2.0, such as from about 1.2 to about 1.8, more typically from about 1.3 to about 1.7. Print uniformity may also be improved with less mottle. For example, embodiments of the coated printable (e.g., paper) webs of the present invention may have 2nd cyan values of about 6 or less, such as about 5 or less, more typically about 4 or less.

Embodiments of the treated paper of the present invention may also provide improved inkjet dry time. Dry time is the time it takes ink to dry on paper or other printing media. If the ink does not dry quickly enough after printing, the ink may transfer to other sheets which are not desirable. In the dry time measurement, 3 seconds is allowed for the print to dry and the black optical density is measured on the transfer sheet which is set on top of the printed area and rolled with a 5-lb roller to ensure consistent contact pressure. The percentage of ink transferred is recorded as a measure of the dry time. The higher the amount of the percentage of ink transferred, the slower (worse) the dry time. Conversely, the lower the amount of the percentage of ink transferred, faster (better) the dry time. Suitable dry times may be less than or equal to about 25% ink transferred transfer, as measured in Example 2 below (see $OD_t$).

Embodiments of the composition of the present invention comprise a coating composition comprising: a calcium carbonate pigment component (e.g., in an amount from about 70 to about 95% by weight of the composition, more typically from about 80 to about 92% by weight of the composition) comprising a mixture high and low surface area calcium carbonate pigment; a metal salt drying agent (e.g., in an amount from about 1 to about 10% by weight of the composition, more typically from about 1 to about 5% by weight of the composition); a cationic dye fixing agent (e.g., in an amount from about 1 to about 10% by weight of the composition, more typically from about 2 to about 6% by weight of the composition); pigment binder (e.g., in an amount from about 1 to about 10% by weight of the composition, more typically from about 2.5 to about 7% by weight of the composition); optionally a plastic pigment (e.g., in an amount from 0 to about 10% by weight of the composition, more typically from about 0 to about 5% by weight of the composition); and optionally an optical brightening agent (e.g., in an amount from about 0 to about 30% by weight of the composition, more typically from about 0 to about 20% by weight of the composition); wherein the coating composition is optionally substantially free of starch and/or latex binder and provides:

- optionally a gloss finish measured at 75 degrees of greater than about 10% (e.g., from about 10 to about 85%, more typically from about 20 to about 75%);
- optionally an internal sizing of from 0 to about 5 HST (e.g., from about 0.1 to about 5 HST, more typically from about 0.1 to about 4 HST);
- a solids content of at least about 25% by weight (e.g., from about 25 to about 75% by weight, more typically from about 35 to about 65% by weight);
- optionally a viscosity of from about 30 to about 800 cps, for example, from about 30 to about 300 cps when used with size presses, and from about 300 to about 800 cps when used with blade coaters;
- a ratio of high surface area calcium carbonate to low surface area calcium carbonate in the range of from about 0.5:1 to about 20:1 (e.g., from about 1:1 to about 19:1, more typically from about 1:1 to about 4:1); and
- a ratio of calcium carbonate pigment component to pigment binder in the range of from about 4:1 to about 50:1 (e.g., from about 10:1 to about 33.3:1, more typically from about 20:1 to about 50:1).

Embodiments of the article of the present invention may comprise:

a printable web having first and second surfaces; and a coating on at least one of the first and second surfaces (e.g., one or both sides or surfaces), wherein the coating provides a printable web surface loading on each surface on which the coating is present is in an amount of at least about 3 gsm (e.g., from about 3 to about 30 gsm), for example, from about 3 to about 10 gsm (e.g., from about 8 to about 10 gsm) for a size press, and from about 6 about 30 gsm (e.g., from about 7 to about 20 gsm) for a blade coater;

wherein the coating comprises: a calcium carbonate pigment component (e.g., in an amount from about 70 to about 95% by weight of the coating, more typically from about 80 to about 92% % by weight of the coating) comprising a mixture high and low surface area calcium carbonate pigment; a metal salt drying agent (e.g., in an amount from about 1 to about 10% by weight of the coating, more typically from about 1 to about 5% by weight of the coating); a cationic dye fixing agent (e.g., in an amount from about 1 to about 10% by weight of the coating, more typically from about 2 to about 6% by weight of the coating); pigment binder (e.g., in an amount from about 1 to about 10% by weight of the coating, more typically from about 2.5 to about 7% by weight of the coating); a plastic pigment (e.g., in an amount from about 0 to about 10% by weight of the coating, more typically from about 0 to about 5% by weight of the coating); and optionally an optical brightening agent (e.g., in an amount from about 0 to about 30% by weight of the coating, more typically from about 0 to about 20% by weight of the coating); whe rein the coating is optionally substantially free of starch and/or latex binder and has: a ratio of high surface area calcium carbonate to low surface area calcium carbonate in the range of from about 0.5:1 to about 20:1 (e.g., from about 1:1 to about 19:1, more typically from about 1:1 to about 4:1); and a ratio of calcium carbonate pigment component to pigment binder in the range of from about 4:1 to about 50:1 (e.g., from about 10:1 to about 33.3:1, more typically from about 20:1 to about 50:1); and wherein the coating provides: a printable web surface loading on each surface on which the coating is present is in an amount of at least about 3 gsm (e.g., from about 3 to about 30 gsm), for example, from about 3 to about 10 gsm (e.g., from about 8 to about 10 gsm) for a size press, and from about 6 about 30 gsm (e.g., from about 7 to about 20 gsm) for a blade coater; and optionally an internal sizing of from 0 to about 5 HST e.g., from about 0.1 to about 5 HST, more typically from about 0.1 to about 4 HST).

Embodiments of the method of the present invention may comprise the following steps of:

(a) providing an uncoated or a single-side coated paper web having first and second surfaces; and (b) providing a coating composition comprising: a calcium carbonate pigment component comprising a mixture high and low surface area calcium carbonate pigment; a metal salt drying agent; a cationic dye fixing agent; pigment binder; optionally a plastic pigment (for improved gloss); and optionally an optical brightening agent (in the amounts described above);

wherein the coating composition is optionally substantially free of latex binder and has: a ratio of high surface area calcium carbonate to low surface area calcium carbonate in the range of from about 0.5:1 to about 20:1 (e.g., from about 1:1 to about 19:1, more typically from about 1:1 to about 4:1); and a ratio of calcium carbonate pigment component to pigment binder in the range of from about 4:1 to about 50:1 (e.g., from about 10:1 to about 50:1, more typically from about 20:1 to about 50:1;

wherein the coating composition: provides a gloss finish measured at 75 degrees of greater than about 10% 10 to about 85%, more typically from about 20 to about 75%); optionally provides an internal sizing of from 0 to about 5 HST (e.g., from about 0.1 to about 5 HST, more typically from about 0.1 to about 4 HST); and has a solids content of at least about 25% by weight (e.g., from about 25 to about 75% by weight, more typically from about 35 to about 65% by weight); and (c) treating at least one of the first and second surfaces of the paper web of step (a) with the coating of step (b), wherein the printable web surface loading on each surface on which the coating is present is in an amount at least about 3 gsm (e.g., from about 3 to about 30 gsm), for example, from about 3 to about 10 gsm (e.g., from about 8 to about 10 gsm) for a size press, and from about 6 about 30 gsm (e.g., from about 7 to about 20 gsm) for a blade coater.

Embodiments the method of the present invention are further illustrated in FIGS. 1 through 5. Referring to FIG. 1, an embodiment of a system for carrying out an embodiment of the method of the present invention is illustrated which may be in the form of, for example a rod metering size press indicated generally as 100. Size press 100 may be used to coat a paper web, indicated generally as 104. Web 104 moves in the direction indicated by arrow 106, and which has a pair of opposed sides or surfaces, indicated, respectively, as 108 and 112.

Size press 100 includes a first assembly, indicated generally as 114, for applying the coating composition to surface 108. Assembly 114 includes a first reservoir, indicated generally as 116, provided with a supply of a coating composition, indicated generally as 120. A first take up roll, indicated generally as 124 which may rotate in a counterclockwise direction, as indicated by curved arrow 128, picks up an amount of the coating composition from supply 120. This amount of coating composition that is picked up by rotating roll 124 may then be transferred to a first applicator roll, indicated generally as 132, which rotates in the opposite and clockwise direction, as indicated by curved arrow 136. (The positioning of first take up roll 124 shown in FIG. 1 is simply illustrative and roll 124 may be positioned in various ways relative to first applicator roll 132 such that the coating composition is transferred to the surface of applicator roll 132.) The amount of coating composition that is transferred to first applicator roll 132 may be controlled by metering rod 144 which spreads the transferred composition on the surface of applicator roll 132, thus providing relatively uniform and consistent thickness of a first coating, indicated as 148, when applied onto the first surface 108 of web 104 by applicator roll 232.

As shown in FIG. 1, size press 100 may also be provided with a second assembly indicated generally as 152, for applying the coating composition to surface 112. Assembly 152 includes a second reservoir indicated generally as 156, provided with a second supply of a coating composition, indicated generally as 160. A second take up roll, indicated generally as 164 which may rotate in a clockwise direction, as indicated by curved arrow 168, picks up an amount of the coating composition from supply 160. This amount of coating composition that is picked up by rotating roll 164 may then be transferred to second take up roll, indicated generally as 172, which rotates in the opposite and counterclockwise direction, as indicated by curved arrow 176. As indicated in FIG. 1 by the dashed-line box and arrow 176, second take up roll 164 may be positioned in various ways relative to second applicator roll 172 such that the coating composition is transferred to the surface of applicator roll 172. The amount of coating composition that is transferred to second applicator roll 172 may be controlled by a second metering rod 184 which spreads the transferred composition on the surface of applicator roll 172, thus providing relatively uniform and consistent thickness of the second coating, indicated as 188, when applied onto the second surface 112 of web 104 by applicator roll 172.

Figure 2:
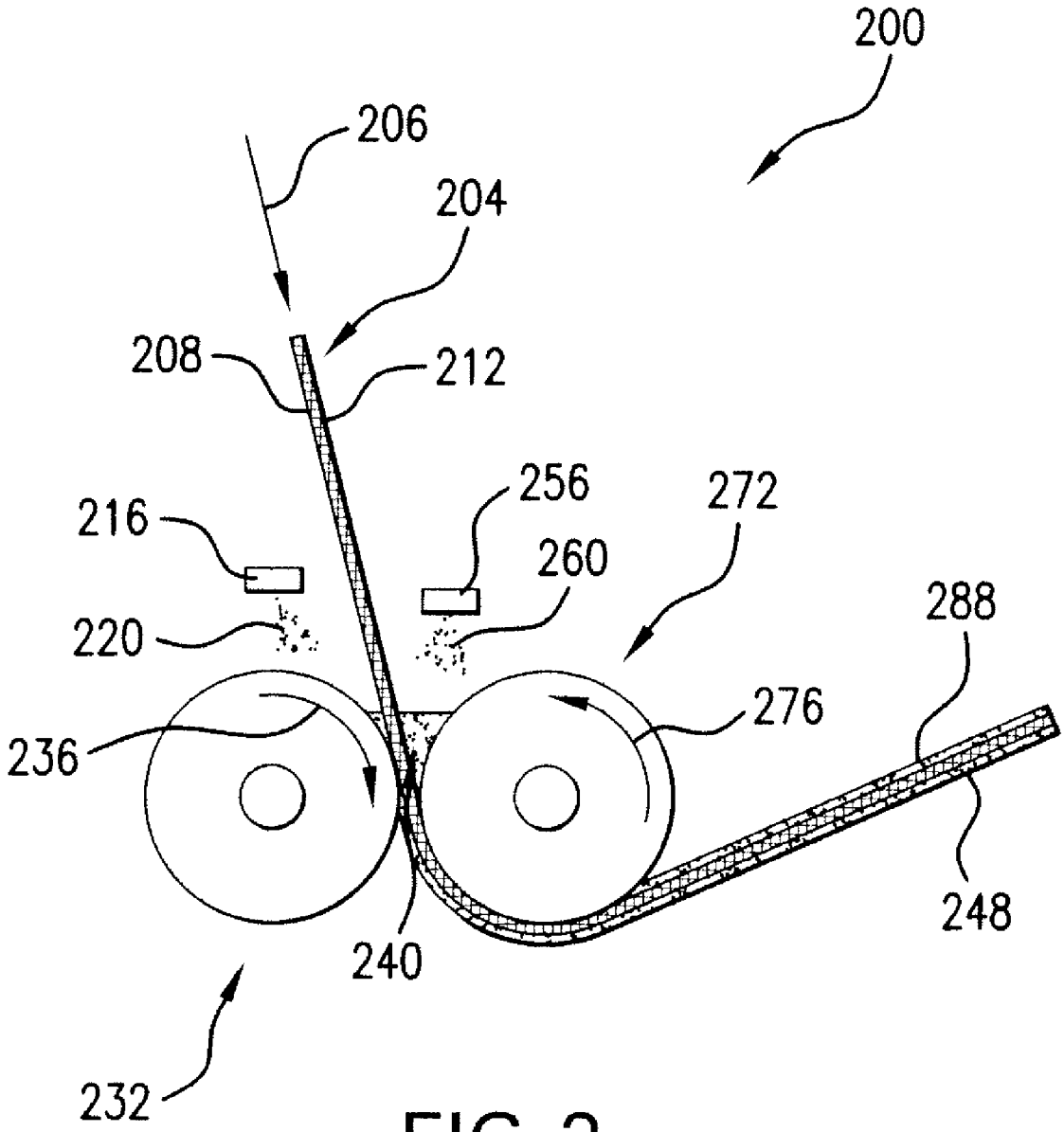
FIG. 2 is a schematic diagram illustrating an embodiment of a method for coating a paper web with a coating composition according to the present invention using a horizontal flooded nip size press.

Referring to FIG. 2, another embodiment of a system for carrying out an embodiment of the method of the present invention is illustrated which may be in the form of, for example, a horizontal flooded nip size press indicated generally as 200. Horizontal size press 200 may be used to coat a paper web, indicated generally as 204. Web 204 moves in the direction indicated by arrow 206, and has a pair of opposed sides or surfaces, indicated, respectively, as 208 and 212.

Horizontal size press 200 includes a first source of a coating composition, indicated generally as nozzle 216, which is sprays a stream of a coating composition, indicated by 220, generally downwardly towards the surface of a first transfer roll, indicated as 232, which rotates in a clockwise direction, as indicated by curved arrow 236. A flooded pond or puddle, indicated generally as 240, is created at the nip between first transfer roll 232 and second transfer roll 272 due to a bar or dam (not shown) positioned at below the nip. Transfer roll 232 transfers a relatively uniform and consistent thickness of a first coating of the coating composition, indicated as 248, onto the first surface 208 of web 204.

A second source of a coating composition, indicated generally as nozzle 256, which is sprays a stream of coating composition, indicated by 260, generally downwardly towards the surface of a second transfer roll, indicated as 272, which rotates in a counterclockwise direction, as indicated by curved arrow 276. Transfer roll 272 transfers a relatively uniform and consistent thickness of a second coating of the coating composition, indicated as 288, onto the second surface 212 of web 204.

Figure 3:
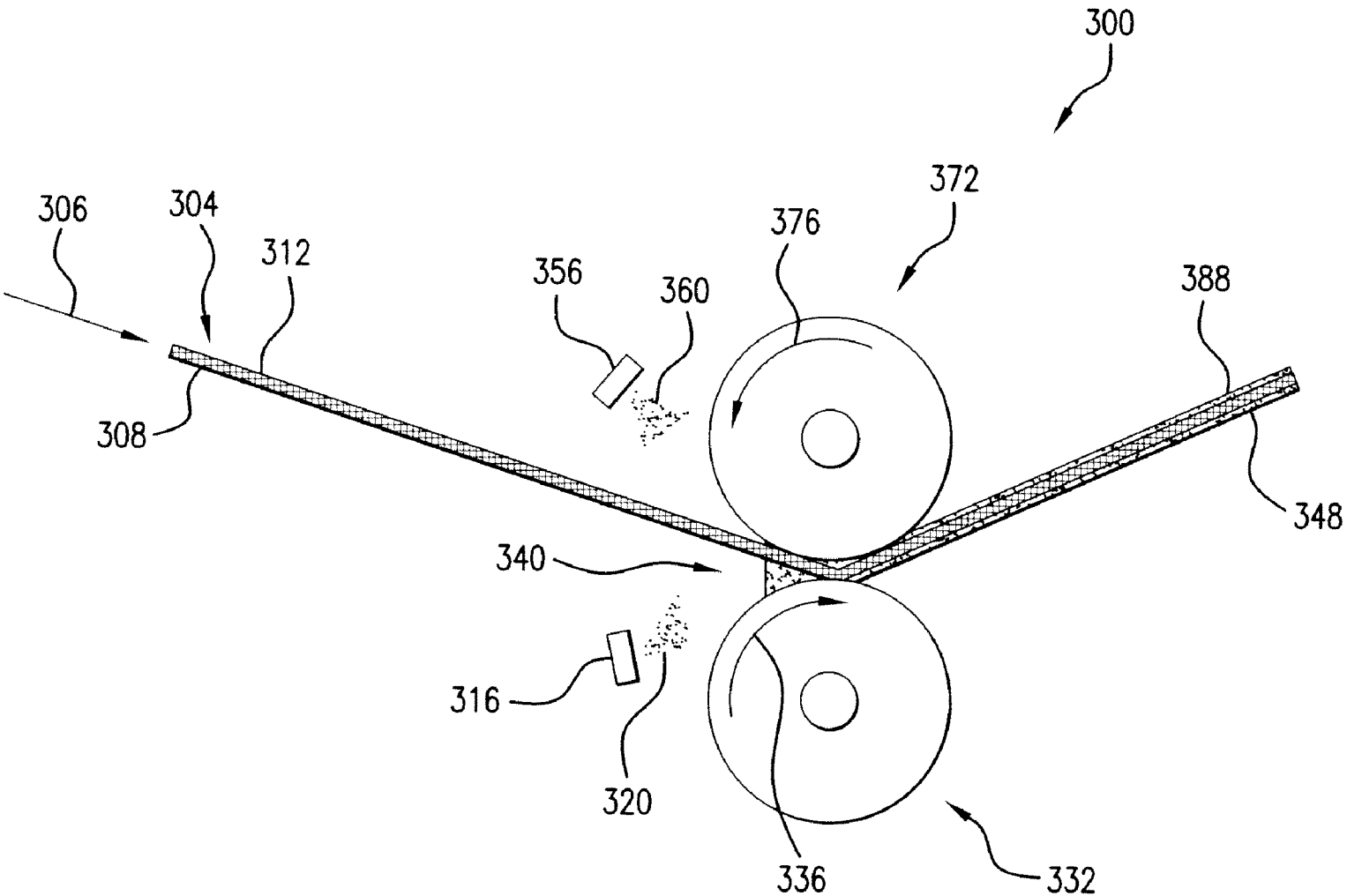
FIG. 3 is a schematic diagram illustrating an embodiment of a method for coating a paper web with a with a coating composition according to the present invention using a vertical flooded nip size press.

Referring to FIG. 3, another embodiment of a system for carrying out an embodiment of the method of the present invention is illustrated which may be in the form of, for example, a vertical flooded nip size press indicated generally as 300. Vertical size press 300 may be used to coat a paper web, indicated generally as 304. Web 304 moves in the direction indicated by arrow 306, and has a pair of opposed sides or surfaces, indicated, respectively, as 308 and 312.

Vertical size press 300 includes a first source of a coating composition, indicated generally as nozzle 316, which is sprays a stream of a coating composition, indicated by 320, generally upwardly and towards the surface of a first lower transfer roll of the roll stack, indicated as 332, which rotates in a clockwise direction, as indicated by curved arrow 336. A smaller flooded pond or puddle, indicated generally as 340, (compared to the pond or puddle 240 of horizontal size press 200) is created at the nip between lower first transfer roll 232 and second upper transfer roll 272 due to a bar or dam (not shown) positioned to right of the nip. Transfer roll 332 transfers a relatively uniform and consistent thickness of a first coating of the coating composition, indicated as 348, onto the lower first surface 308 of web 304.

A second source of a coating composition, indicated generally as nozzle 356, which is sprays a stream of the coating composition, indicated by 360, generally downwardly and towards the surface of a second upper transfer roll, indicated as 372, which rotates in a counterclockwise direction, as indicated by curved arrow 376. Transfer roll 372 transfers a relatively uniform and consistent thickness of a second coating of the coating composition, indicated as 388, onto the upper second surface 312 of web 304.

Figure 4:
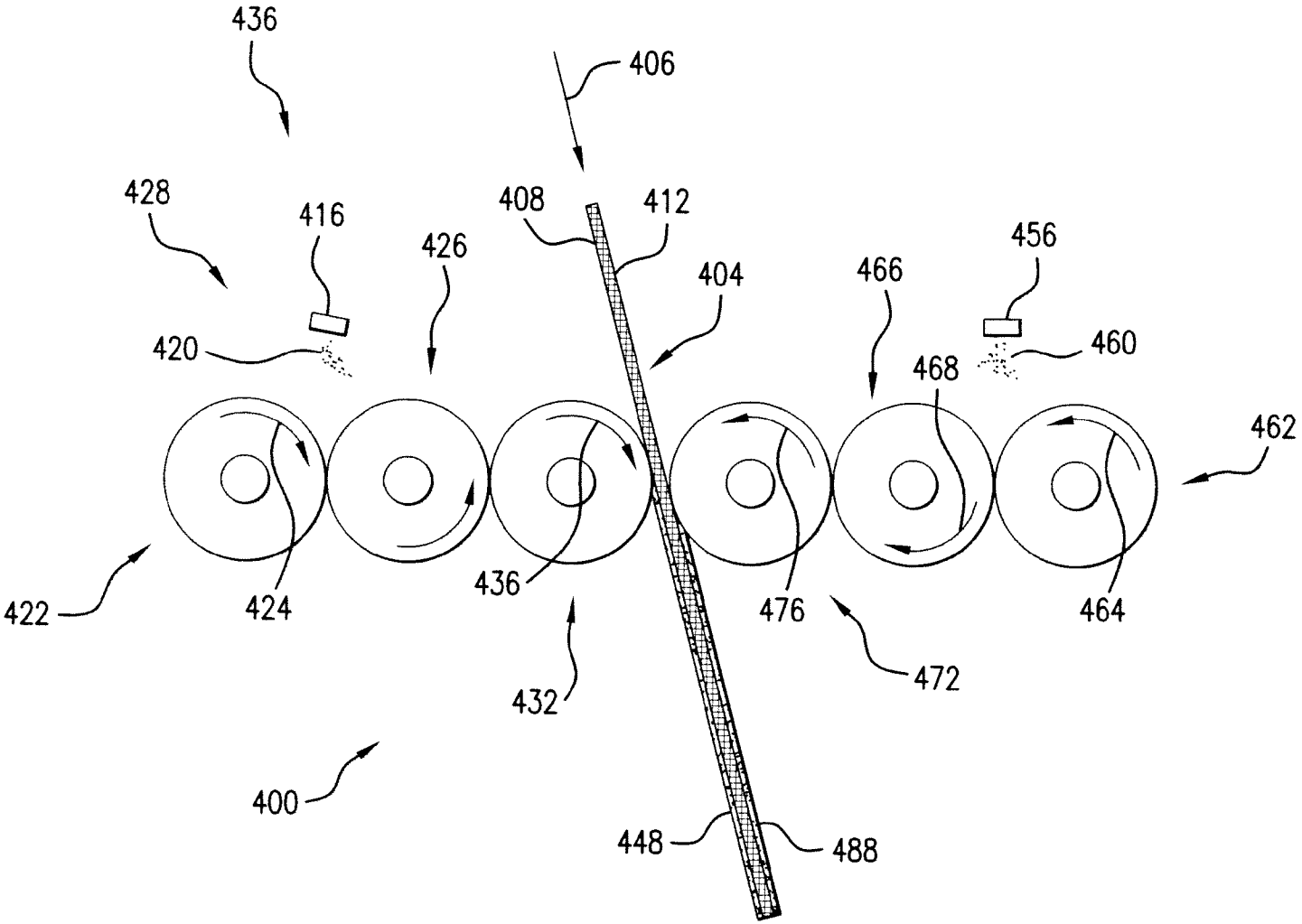
FIG. 4 is a schematic diagram illustrating an embodiment of a method for coating a paper web with a coating composition according to the present invention using a gated roll size press.

Referring to FIG. 4, another embodiment of a system for carrying out an embodiment of the method of the present invention is illustrated which may be in the form of, for example a gated roll size press indicated generally as 400. Size press 400 may be used to coat a paper web, indicated generally as 404. Web 404 moves in the direction indicated by arrow 406, and which has a pair of opposed sides or surfaces, indicated, respectively, as 408 and 412.

Gated roll size press 400 includes a first source of a coating composition, indicated generally as nozzle 416, which is sprays a stream of paper composition, indicated by 420, generally downwardly towards the surface of a first gated roll, indicated as 422, which rotates in a clockwise direction, as indicated by curved arrow 424. A first transfer roll, indicated as 426, which rotates in the opposite and counterclockwise direction, as indicated by curved arrow 428, picks up the coating composition on the surface of first gated roll 422. A first applicator roll, indicated as 432, which may have either a hard or soft surface, and which rotates in the opposite and clockwise direction relative to first transfer roll 426, as indicated by curved arrow 436, receives the coating composition from the surface of first transfer roll 426 and applies a relatively uniform and consistent thickness of a first coating of the coating composition, indicated as 448, onto the first surface 408 of web 404.

Gated roll size press 400 may also include a second source of a coating composition, indicated generally as nozzle 456, which is sprays a stream of paper composition, indicated by 460, generally downwardly towards the surface of a second gated roll, indicated as 462, which rotates in a counterclockwise direction, as indicated by curved arrow 464. A second transfer roll, indicated as 466, which rotates in the opposite and clockwise direction, as indicated by curved arrow 468, picks up the coating composition on the surface of first gated roll 462. A second applicator roll, indicated as 472, which may have either a hard or soft surface, and which rotates in the opposite and counterclockwise direction relative to second transfer roll 466, as indicated by curved arrow 476, receives the coating composition from the surface of second transfer roll 466 and applies a relatively uniform and consistent thickness of a first coating of the coating composition, indicated as 488, onto the first surface 412 of web 404.

Figure 5:
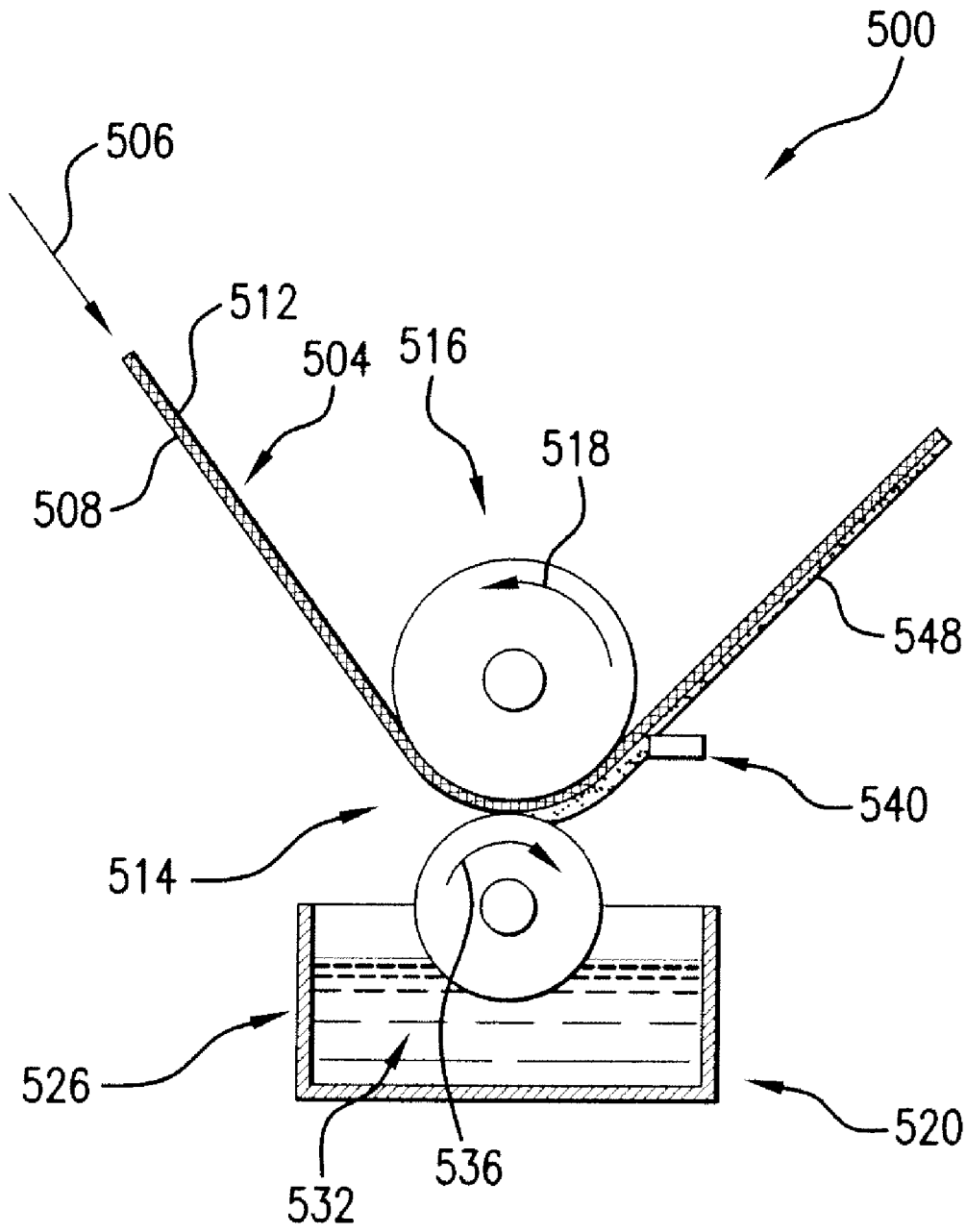
FIG. 5 is a schematic diagram illustrating an embodiment of a method for coating a paper web with a coating composition according to the present invention using a roll applicator blade coater.

Referring to FIG. 5, another embodiment of a system for carrying out an embodiment of the method of the present invention is illustrated which may be in the form of, for example a roll applicator blade coater (also referred to as a flooded nip inverted blade coater) indicated generally as 500. Blade coater 500 may be used to coat a paper web, indicated generally as 504. Web 504 moves in the direction indicated by arrow 506, and which has a pair of opposed sides or surfaces, indicated, respectively, as 508 and 512.

Blade coater 500 includes a coater assembly, indicated generally as 514, for applying the coating composition to surface 508. Assembly 514 includes a backing roll, indicated generally as 516, which may rotate counterclockwise and in the direction indicated by curved arrow 518, which is also in the direction that web 504 moves. Assembly 514 further includes a pan 520 provided with a supply 526 of coating composition. An applicator roll, indicated generally as 532, which may rotate in a clockwise direction, as indicated by curved arrow 536, picks up an amount of the coating composition from supply 526. This amount of coating composition that is picked up by applicator roll 532 may then be transferred to surface 508. A doctor blade, indicated as 540, removes the excess coating applied by applicator roll 532 to provide relatively uniform and consistent thickness of a coating, indicated as 548, onto surface 508 of web 504. If desired, assembly 514 may be modified to provide a Billblade two-sided coating system to apply coating to surface 512.

It should be appreciated that the embodiments illustrated in FIGS. 1 through 5 are provided to illustrate the teachings of the present invention. Alterations or modification within the skill of the art of the embodiments in FIGS. 1 through 4 are considered within the scope of the present invention, so long as these alterations or modifications operate in a same or similar manner, function, etc.

Show-Through Test Methodology 1.0 Equipment—Densitometer (X-rite 518)

2.0 Procedure

Print a black box that is 150 mm by 450 mm using the HP deskjet 6122 printer. Prints are made using the plain paper mode and varying the print quality settings (draft, fast normal, normal, best). Using the densitometer, measure density of the printed area, back of print, blank area, and covered print. Measure 3 times per area per sheet.

EXAMPLES

Example 1

The following coating formulations are prepared for the gloss coated inkjet paper:

| Chemicals | Run 1 | Run 2 | Run 3 |
|---|---|---|---|
| High surface area calcium carbonate[1] | 72 | 72 | 72 |
| Low surface area calcium carbonate[2] | 25 | 25 | 25 |
| Plastic pigment[3] | 3 | 3 | 3 |
| PVOH[4] | 7.5 | 5 | 7.5 |
| Cartafix VXZ[5] | 5 | 5 | |
| Calcium Stearate[6] | 1 | 1 | 1 |
| Calcium Chloride | 2 | 2 | 2 |
| Leucophor BCW[7] | 2 | 2 | 2 |
| Thickener[8] | 0.25 | 0.25 | 0.25 |
| Solids %, target | 46 | 45 | 44 |
| pH | 8-9 | 8-9 | 8-9 |
| Brookfield Viscosity, cps | 1000-1500 | 1000-1500 | 1000-1500 |

[1]Omya, Inc. Proctor, VT 05765 (same as Example 2)
[2]Omya, Inc. Proctor, VT 05765 (same as Example 2)
[3]Dow Chemical Company, Midland, Michigan 48674
[4]Celanese Chemicals, Dallas, TX 75234
[5]Cartafix VXZ from Clariant Corp., Charlotte, NC 28205 (cationic dye fixing agent)
[6]Calcium stearate from Omnova Solutions, Inc, Akron, Ohio 44305
[7]Leucophor BCW from Clariant Corp., Charlotte, NC 28205
[8]Polyacrylate The pigment slurries of high surface area calcium carbonate and low surface area calcium carbonate and plastic pigments are mixed well under high shear. Polyvinyl alcohol (PVOH), lubricant (calcium stearate) and optical brightening agent (Leucophor BCW) are then added under shear. A blade coater is used to apply the coating onto a paper substrate (web). Both sides of the paper are coated. The paper web surface loading target with the coating is 8-10 gsm. The coated paper samples are calendered using lab calendar to achieve a target gloss of 50% at 75 degree gloss.

The physical property measurements for Runs 1 through 3, compared to a commercial gloss coated paper, are shown in Table 1:

TABLE 1

Physical Property Measurements

| Properties | Run 1 | Run 2 | Run 3 | Commercial gloss coated paper[1] |
|---|---|---|---|---|
| TAPPI Gloss (at 75 degrees) | 52 | 56 | 54 | 45 |
| Black Print density | 1.5 | 1.5 | 1.3 | 1.9 |
| Dry time | GOOD | GOOD | GOOD | POOR |
| Color-to-Color Bleed | GOOD | GOOD | GOOD | POOR |

| Chemicals | Parts |
|---|---|
| Fine precipitated calcium carbonate | 62 |
| Clay | 30 |
| Calcined clay | 5 |
| Hollow Sphere Plastic Pigment | 3 |
| Styrene Butadiene Acrylonitrile latex | 6 |
| Polyvinyl alcohol | 6 |
| Starch | 3 |
| Thickener | 0-2 |
| Calcium Stearate | 1 |
| Optical brightener | 2 |

| Property | Amount |
|---|---|
| Target Solids (%) | 40-42 |
| pH | 8-9 |
| Brookfield Viscosity (cps) | 1200-2000 |

[1]Coating Formulation:

Example 2

The dry time for a fast dry coated inkjet paper is measured as follows: The ink dry time is measured by the amount of ink transferred from a printed to an unprinted sheet after rolling with a roller of fixed weight. The test method involves printing solid blocks on test paper sample, waiting for 3 seconds of printing, cover the printed blocks with unprinted paper, and rolling with a 4.5 lb hand roller. The hand roller used in the test was obtained from Chem Instruments, Inc., Mentor, Ohio. The "ink transfer" is defined as the amount of optical density transferred to the unprinted sheet after rolling with a roller. The optical density is read on the transferred ($OD_t$), the non transferred ($OD_0$), and an un-imaged area ($OD_b$) by a reflectance densitometer from X-Rite. The percentage of ink transferred (IT %) is defined as IT %=$[(OD_t-OD_b)/(OD_0-OD_b)]*100$. The lower the percentage of ink transferred, the better the ink dry time.

Table 2 provides data obtained by this method to show the effect of a high surface area calcium carbonate pigment (XC3320) on the ink dry time

TABLE 2

Dry Time Measurements

| High Surface area calcium carbonate, XC3320 | Low surface area calcium carbonate, Hydrocarb 90 | Plastic pigment | % Ink Transferred |
|---|---|---|---|
| 0% | 97% | 3% | 83% |
| 25% | 72% | 3% | 82% |
| 35% | 62% | 3% | 67% |

TABLE 2-continued

| Dry Time Measurements | | | |
|---|---|---|---|
| High Surface area calcium carbonate, XC3320 | Low surface area calcium carbonate, Hydrocarb 90 | Plastic pigment | % Ink Transferred |
| 45% | 52% | 3% | 51% |
| 55% | 42% | 3% | 48% |
| 65% | 32% | 3% | 27% |
| 75% | 22% | 3% | 18% |
| 85% | 12% | 3% | 16% |
| 97% | 0% | 3% | 13% |

Figure 6:
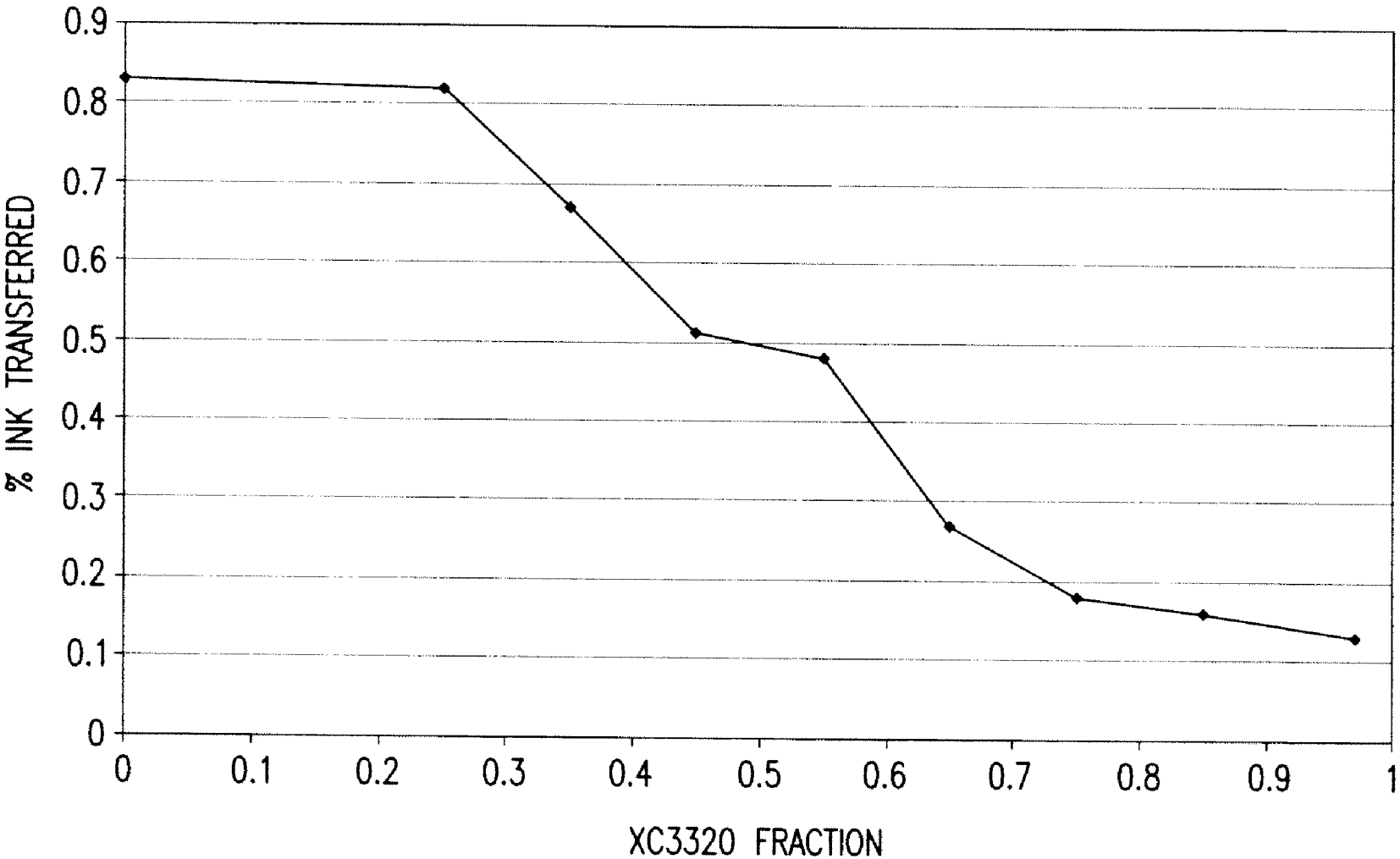
FIG. 6 is a graphical plot of the percentage of ink transferred, versus varying percentages of a high surface area calcium carbonate pigment present in a coating formulation.

FIG. 6 is a graphical plot of the data of Table 2 as a percentage of ink transferred, versus varying percentages of XC 3320 pigment present in the coating formulation. As shown by FIG. 6, as the percentage of XC 3320 pigment increases in the coating formulation, the percentage of ink transferred decreases, thus showing that the higher surface area XC3320 pigment improves ink dry time.

Example 3

The following coating formulations are prepared for the matte coated inkjet paper:

| Chemicals | Run 1 | Run 2 | Run 3 |
|---|---|---|---|
| High surface area calcium carbonate[1] | 55 | 55 | 55 |
| Low surface area calcium carbonate[2] | 45 | 45 | 45 |
| Starch[3] | 6 | 6 | 6 |
| PVOH[4] | 4 | 4 | 4 |
| Nalcat 2020[5] | 2 | 2 | 2 |
| Calcium Stearate[6] | 1 | 1 | 1 |
| Calcium Chloride | 2 | 2 | 2 |
| Thickener[7] | 0.1 | 0 | 0 |
| Solids %, target | 42 | 42 | 42 |
| pH | 8-9 | 8-9 | 8-9 |
| Brookfield Viscosity, cps | 800-1200 | 800-1200 | 800-1200 |

[1]Omya, Inc. Proctor, VT 05765 (same as Example 2)
[2]Omya, Inc. Proctor, VT 05765 (Run 1 = same as Example 2, Run 2 and 3 = Setacarb)
[3]Dow Chemical Company, Midland, Michigan 48674
[4]Celanese Chemicals, Dallas, TX 75234
[5]Nalco Corp., Naperville, IL 60563 (cationic dye fixing agent)
[6]Calcium stearate from Omnova Solutions, Inc, Akron, Ohio 44305
[7]Polyacrylate The pigment slurries of high surface area calcium carbonate and low surface area calcium carbonate are mixed well under high shear. Starch, polyvinyl alcohol (PVOH), lubricant (calcium stearate) and other additives are then added sequentially under shear. A blade coater is used to apply the coating onto a paper substrate (web). Both sides of the paper are coated. The paper web surface loading target with the coating is 9 gsm for Run 1 and 2, and 5 gsm for Run 3. The coated paper samples are calendered using lab calendar to achieve a target gloss of 25% at 75 degree. The ratio of calcium carbonate pigment component to pigment binder is preferably in the range of from about 4:1 to about 50:1. Alternatively, this ratio may include 5:1 to about 50:1 or 6:1 to about 50:1 or 7:1 to about 50:1 or 8:1 to about 50:1 or 9:1 to about 50:1 or 10:1 to about 50:1 or 4:1 to about 33.3:1 or 5:1 to about 33.3:1 or 6:1 to about 33.3:1 or 7:1 to about 33.3:1 or 8:1 to about 33.3:1 or 9:1 to about 33.3:1 or 10:1 to about 33.3:1 including any and all ranges and subranges therein.

The physical property measurements for Runs 1 through 3, compared to a commercial gloss coated paper, are shown in Table 1:

TABLE 1

| Physical Property Measurements | | | | |
|---|---|---|---|---|
| Properties | Run 1 | Run 2 | Run 3 | Commercial gloss coated paper[1] |
| TAPPI Gloss (at 75 degrees) | 25 | 25 | 25 | 45 |
| Black Print density | 1.4 | 1.4 | 1.4 | 1.9 |
| Dry time | GOOD | GOOD | GOOD | POOR |
| Color-to-Color Bleed | GOOD | GOOD | GOOD | POOR |

| Chemicals | Parts |
|---|---|
| Fine precipitated calcium carbonate | 62 |
| Clay | 30 |
| Calcined clay | 5 |
| Hollow Sphere Plastic Pigment | 3 |
| Styrene Butadiene Acrylonitrile latex | 6 |
| Polyvinyl alcohol | 6 |
| Starch | 3 |
| Thickener | 0-2 |
| Calcium Stearate | 1 |
| Optical brightener | 2 |

| Property | Amount |
|---|---|
| Target Solids (%) | 40-42 |
| pH | 8-9 |
| Brookfield Viscosity (cps) | 1200-2000 |

[1]Coating Formulation:

All documents, patents, journal articles and other materials cited in the present application are hereby incorporated by reference.

Although the present invention has been fully described in conjunction with several embodiments thereof with reference to the accompanying drawings, it is to be understood that various changes and modifications may be apparent to those skilled in the art. Such changes and modifications are to be understood as included within the scope of the present invention as defined by the appended claims, unless they depart therefrom.

What is claimed is:

1. An article comprising:

a printable web having first and second surfaces; and a coating on at least one of the first and second surfaces, wherein the coating comprises:

a calcium carbonate pigment component comprising a mixture high and low surface area calcium carbonate pigment;

a metal salt drying agent;

a cationic dye fixing agent; and a pigment binder;

wherein the coating has:

a ratio of high surface area calcium carbonate to low surface area calcium carbonate in the range of from about 0.5:1 to about 20:1; and a ratio of calcium carbonate pigment component to pigment binder in the range of from about 4:1 to about 50:1;

wherein the coating provides:

a printable web surface loading on each surface on which the coating is present in an amount of at least about 3 gsm.

2. The article of claim 1, wherein the calcium carbonate pigment component is in an amount from about 70 to about 95% by weight of the composition.

3. The article of claim 2, wherein the ratio of high surface area calcium carbonate to low surface area calcium carbonate is in the range of from about 1:1 to about 19:1.

4. The article of claim 1, wherein the metal salt drying agent is in an amount from about 1 to about 10% by weight of the composition.

5. The article of claim 4, wherein the metal salt drying agent is sodium chloride, calcium chloride, calcium nitrate, magnesium chloride, magnesium nitrate, aluminum chloride, sodium sulfate, aluminum chloride, aluminum nitrate, aluminum sulfate, potassium chloride, sodium aluminum sulfate, vanadium chloride, magnesium sulfate, sodium silicates, or a combination thereof.

6. The article of claim 5, wherein the metal salt drying agent is calcium chloride.

7. The article of claim 1, wherein the cationic dye fixing agent is in an amount from about 1 to about 10% by weight of the composition.

8. The article of claim 7, wherein the cationic dye fixing agent is a polyamine, a polyethyleneimine, a polymer or copolymer of diallyldimethyl ammonium chloride, a copolymer of vinyl pyrrolidone with a quaternized diethylaminoethylmethacrylate, a polyamide, a cationic polyurethane latex, a cationic polyvinyl alcohol, a polyalkylamine dicyandiamid copolymer, an amine glycidyl addition polymer, a poly[oxyethylene (dimethyliminio) ethylene (dimethyliminio) ethylene] dichloride, or a combinations thereof.

9. The article of claim 1, wherein the pigment binder is in an amount from about 1 to about 10% by weight of the composition.

10. The article of claim 9, wherein the pigment binder is a polyvinyl alcohol, a starch binder, a proteinaceous, a polymer latex, or a combination thereof.

11. The article of claim 1, which further comprises a plastic pigment.

12. The article of claim 1, which has a solids content of from about 25 to about 75% by weight.

13. The article on of claim 1, wherein the ratio of calcium carbonate pigment component to pigment binder in the range of from about 10:1 to about 33.3:1.

14. The article of claim 1, which has a viscosity of from about 30 to about 800 cps.

15. The article of claim 1, wherein the coating is present in an amount of from about 7 gsm to about 20 gsm.

16. The article of claim 1, wherein the coating is on one of the first and second surfaces.

17. The article of claim 1, wherein the coating is on both of the first and second surfaces.

18. A method of making the article according to claim 1, comprising the following steps:

(a) providing a printable web having first and second surfaces; and (b) providing a liquid coating composition comprising:

a calcium carbonate pigment component comprising a mixture high and low surface area calcium carbonate pigment;

a metal salt drying agent;

a cationic dye fixing agent; and pigment binder;

wherein the coating composition has:

a ratio of high surface area calcium carbonate to low surface area calcium carbonate in the range of from about 0.5:1 to about 20:1; and a ratio of calcium carbonate pigment component to pigment binder in the range of from about 4:1 to about 50:1;

wherein the coating composition:

has a solids content of at least about 25% by weight; and (c) treating at least one of the first and second surfaces of the printable web of step (a) with the coating composition of step (b), wherein the printable web surface loading on each surface on which the coating is present is in an amount at least about 6 gsm.

19. The method of claim 18, wherein the printable web is treated in step (c) with the composition of step (b) on one of the first and second surfaces.

20. The method of claim 18, wherein the printable web is treated in step (c) with the composition of step (b) on both the first and second surfaces.

* * * * *